US006561866B1

(12) United States Patent
Lee

(10) Patent No.: US 6,561,866 B1
(45) Date of Patent: May 13, 2003

(54) MOVEABLE AND SECTIONAL BLOCK TOY

(76) Inventor: Jeong Min Lee, 484, Shinpyung-Idong, Saha-ku, Pusan 604-031 (KR)

( * ) Notice: Subject to any disclaimer, the term of this patent is extended or adjusted under 35 U.S.C. 154(b) by 0 days.

(21) Appl. No.: 09/889,339

(22) PCT Filed: Sep. 3, 1999

(86) PCT No.: PCT/KR99/00510

§ 371 (c)(1),
(2), (4) Date: Jul. 16, 2001

(87) PCT Pub. No.: WO01/17635

PCT Pub. Date: Mar. 15, 2001

(51) Int. Cl.[7] ..... A63H 17/00; A63H 33/04

(52) U.S. Cl. ..... 446/90; 446/85; 446/91; 446/103

(58) Field of Search ..... 446/85, 86, 90, 446/94, 95, 91, 102, 103, 104, 111, 119, 120, 124, 126, 128

(56) References Cited

U.S. PATENT DOCUMENTS 4,109,398 A * 8/1978 Hida ..... 434/370
4,214,402 A * 7/1980 Ogawa ..... 446/90
4,813,903 A * 3/1989 Furukawa et al. ..... 446/103
4,889,516 A * 12/1989 Auer et al. ..... 446/449
4,998,903 A * 3/1991 Bolli et al. ..... 446/102
5,090,934 A * 2/1992 Quercetti ..... 434/370
5,259,803 A * 11/1993 Lyman ..... 446/103
5,645,463 A * 7/1997 Olsen ..... 446/104
5,919,072 A * 7/1999 Pohlman ..... 446/120
5,924,905 A * 7/1999 Cyrus et al. ..... 434/152
6,315,628 B1 * 11/2001 Quercetti ..... 446/103

* cited by examiner

*Primary Examiner*—Jacob K. Ackun
*Assistant Examiner*—Faye Francis
(74) *Attorney, Agent, or Firm*—Notaro & Michalos P.C.

(57) ABSTRACT

A moveable and sectional block toy, including: a main frame which has a motor operating by receiving the input of a switching signal from the external and driving gears rotating by receiving the driving force of the motor; a plurality of gears which rotate with engaging the driving gear and a plurality of wheels which operate with assembling at a selected gear among the gears; and, a plurality of connection stands for one another connecting the main frame, the gears, and the wheels, thereby shaping one unitary body.

10 Claims, 11 Drawing Sheets

MOVEABLE AND SECTIONAL BLOCK TOY

BACKGROUND OF THE INVENTION

1. Field of the Invention

The present invention relates to a sectional block toy and more particularly, a moveable and sectional block toy which is assembled with having the given format by using blocks of the form of gears.

2. Description of the Related Art

Generally, a sectional toy using blocks has been developed and used as various forms and is constructed with getting two or three rectangular blocks between themselves and crossing the above rectangular blocks so that children can enjoy the play for obtaining the assembled of arbitrary and various forms, where the aforesaid rectangular blocks have the rectangular form and have the ratio of length and breadth different from one another.

Also, blocks for assembling toys having all kinds are provided for increasing the originality of the children, improving their ability to concentrate all their energies, and arousing their curiosity and mostly for promoting their ability to assemble the form such as guns, an electric car, and a robot with making sectional blocks having the plurality of inserting grooves and rectangular protrusions as a plurality of various forms into one set.

However, since the sectional block toys as stated above are very simply are constructed, even though the sectional block toys are assembled as all kinds of forms, the cubic effect is deteriorated as well as the forms are not elegant. Therefore, it has a disadvantage in not satisfying the satisfactoriness that the children desire. Further, it is relatively difficult to assemble the blocks as patterns of various forms that the children desire and it is easily tedious to assemble the blocks. Resultedly, wasted blocks may be increased.

In the meanwhile, Korean Laid-Open Utility Model Laid-Open Nos. 98-36109 (Title: Sectional Block Toy) and 99-4560 (Title: Sectional Toy Using Blocks) correspond to the prior art for solving the above-mentioned problem.

Like the aforesaid prior art, the laid-open Utility Models use simple block construction. As a result, not only the children easily feel tedious to the simple block construction but also the it can provide no helps in developing their intellectual powers on the operation principle of the machine. In addition, the prior art frequently inquire moveable other toys because the assembled block toy can not move solely, thereby increasing economic load to the parent.

SUMMARY OF THE INVENTION

It is therefore an object of the present invention for solving the above problem to provide a moveable and sectional block toy which is assembled with having the given format by using blocks of the form of gears.

It is another object of the present invention to provide a moveable and sectional block toy for recognizing the operation principles of the machine to children while amusing themselves at the play.

It is a further object of the present invention to provide a moveable and sectional block toy for recognizing the state of the power transmission of gear to children.

These and other objects can be achieved according to the present invention with a moveable and sectional block toy, comprising: a main frame which has a motor operating by receiving the input of a switching signal from the external and driving gears rotating by receiving the driving force of the motor; a plurality of gears which rotate with engaging the driving gear and a plurality of wheels which operate with assembling at a selected gear among the gears; and, a plurality of connection stands for one another connecting the main frame, the gears, and the wheels, thereby shaping one unitary body.

BRIEF DESCRIPTION OF THE DRAWINGS

A more complete appreciation of this invention, many of the attendant advantages thereof, will be readily apparent as the same becomes better understood by reference to the following detailed description when considered in conjunction with the accompanying drawings, in which like reference symbols indicate the same or similar elements components, wherein, FIG. 1 including (A) to (T) is a perspective view illustrating each of elements for constructing a moveable and sectional block toy according to a preferred embodiment of the present invention.

DETAILED DESCRIPTION OF THE PREFERRED EMBODIMENTS

Figure 1:
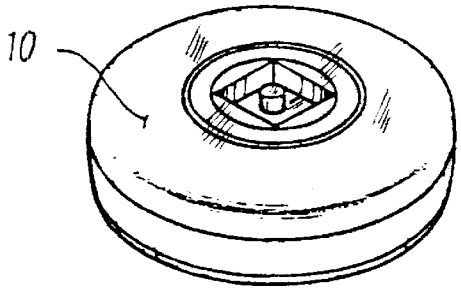
Figure 1:
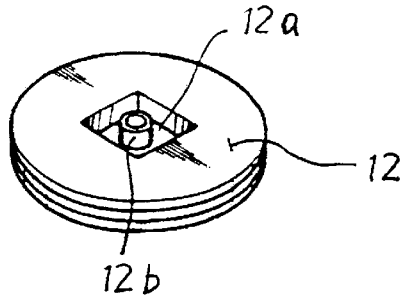
Figure 1:
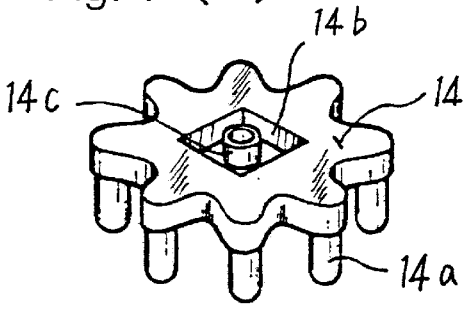
Figure 1:
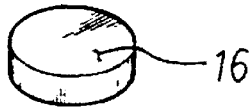
Figure 1:
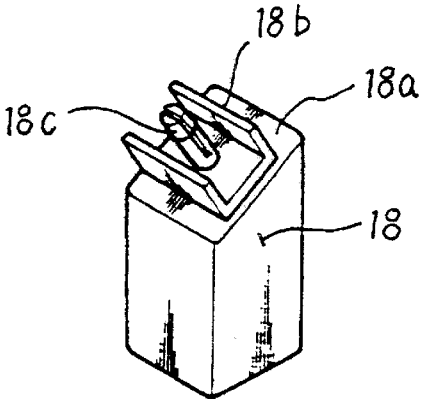
Figure 1:
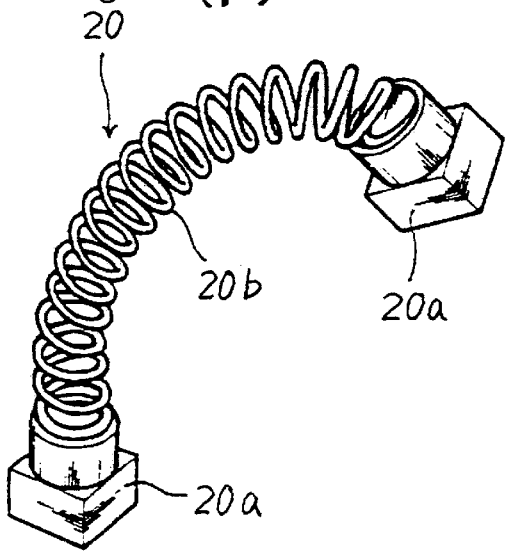
Figure 1:
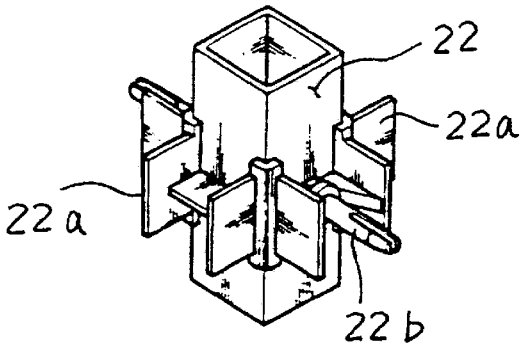
Figure 1:
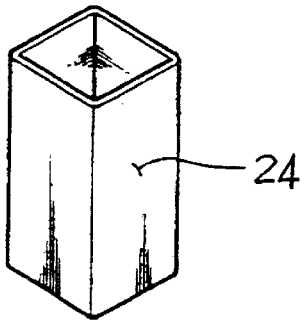
Figure 1:
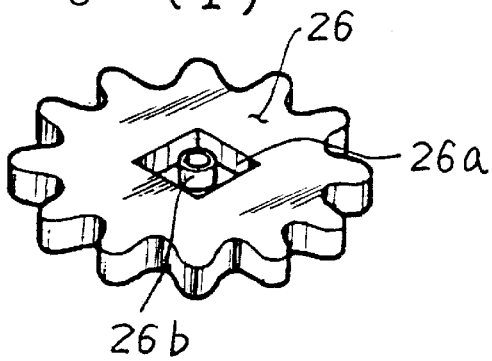
Figure 1:
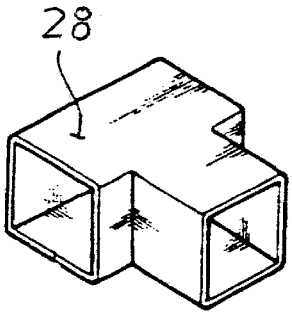
Figure 1:
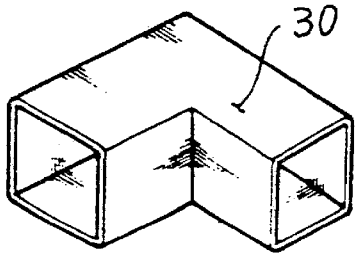
Figure 1:
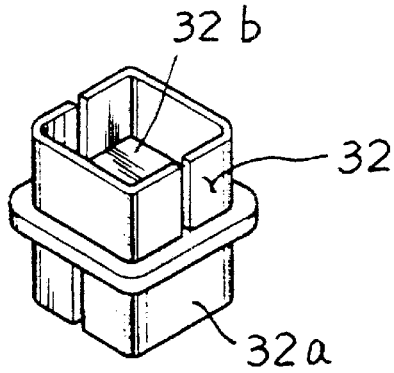
Figure 1:
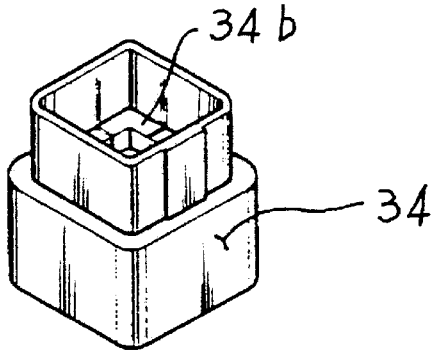
Figure 1:
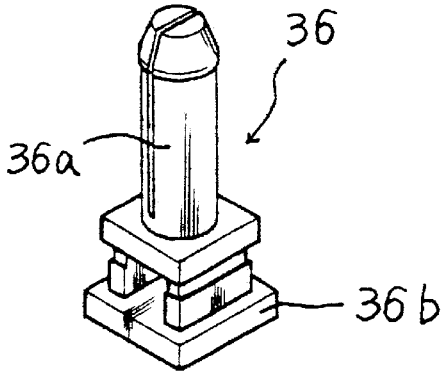
Figure 1:
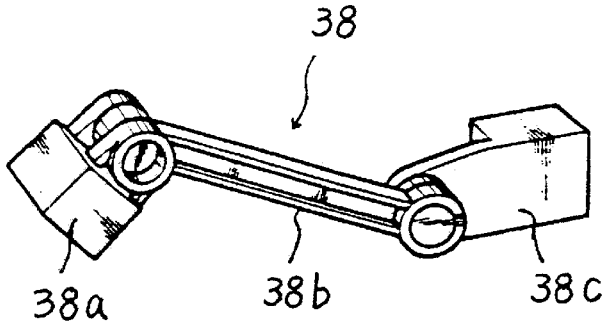
Figure 1:
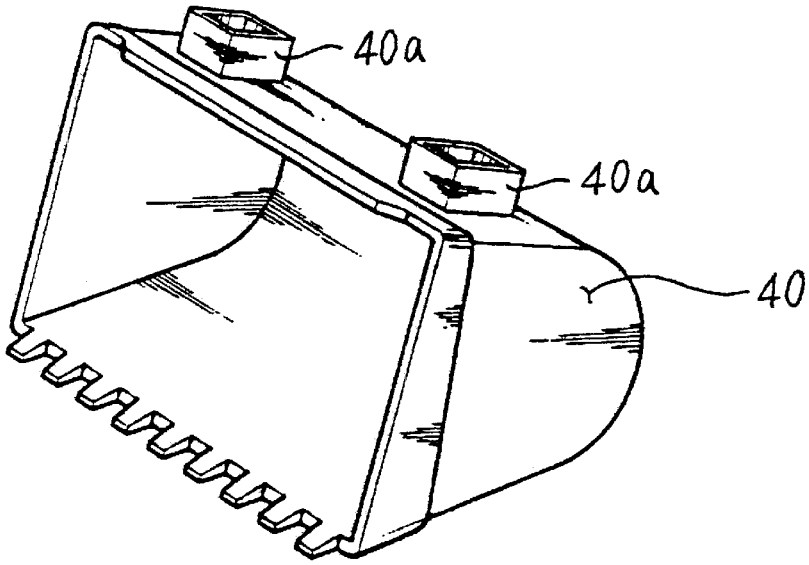
Figure 1:
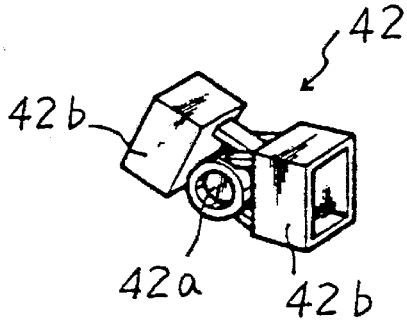
Figure 1:
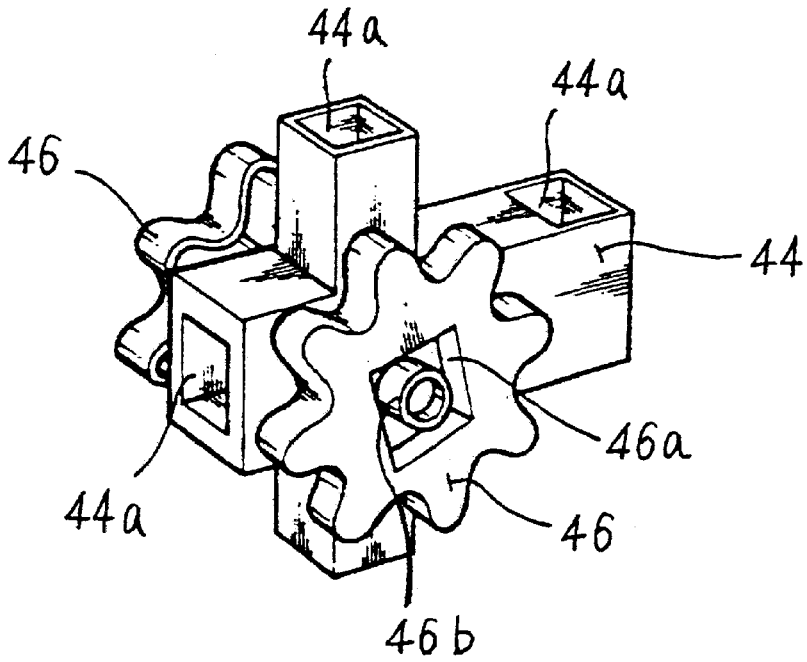
Figure 1:
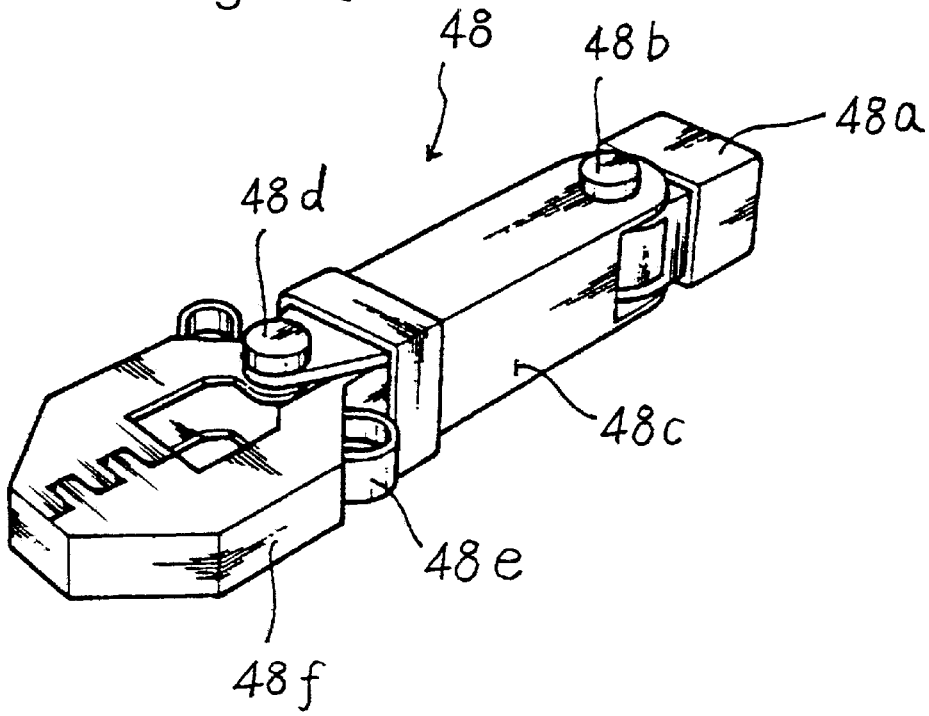
Figure 1:
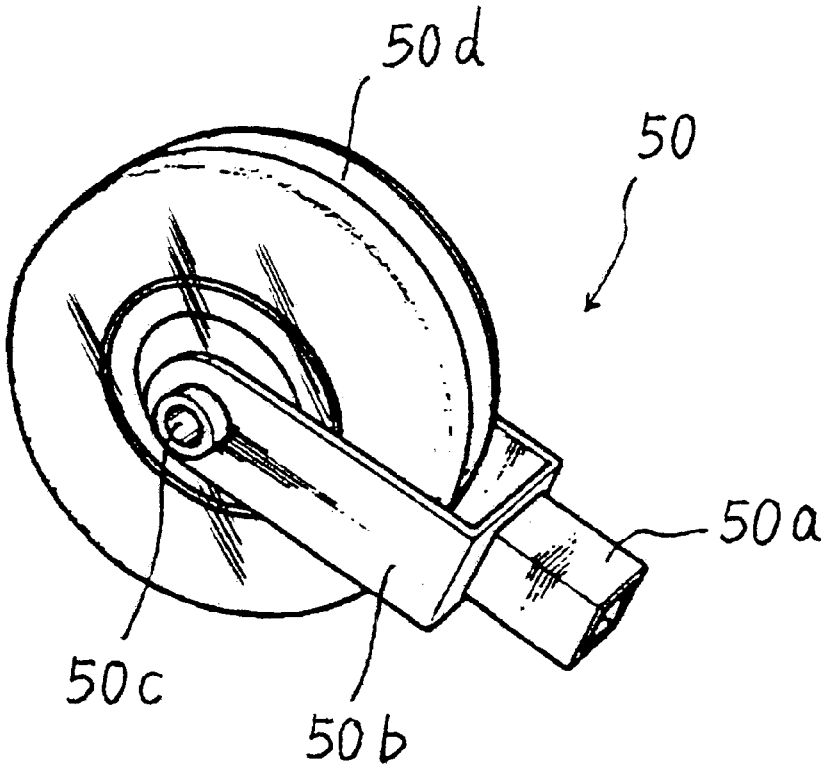

Hereinafter, a preferred embodiment of the present invention will be in detail explained with reference to the accompanying drawings. Most of all, throughout the drawings, it is noted that the same reference numerals of the letter will be used to designate like or equipment elements having the same function. Further, in the following description, numerous specific details are set forth to provide a more thorough understanding of the present invention. It will be apparent, however, to one skilled in the art that the present invention may be practiced without these specific details. A detailed description of known functions and constructions unnecessarily obscuring the subject matter of the present invention has been omitted in the following description for clarity.

FIG. 1 including (A) to (T) is a sectional view illustrating each of elements for constructing a moveable and sectional block toy according to a preferred embodiment of the present invention, more particularly, the elements used for assembling a wheel excavator, a bulldozer, an elephant tractor, and a robot as shown in accompanying FIGS. 2 to 5.

(A) of FIG. 1 depicts the configuration of a wheel among block elements according to the present invention, and the wheel 10 operate with assembling with a driven gear as will be described hereinafter.

(B) of FIG. 1 depicts the configuration of a pulley 12 and the pulley 12 is used as the replacement of the aforesaid wheel 10 or solely. A square groove 12*a* is formed at one surface of the pulley 12 and a cylindrical protrusion 12*b* is formed at the center of the square groove 12*a*. At this time, a wheel cap 16 is coupled to the square groove 12*a* and the protrusion 12*b*, a projection unit (not shown) is formed at the other surface of the pulley 12, the afore-mentioned driven gear 26 is assembled at the projection unit.

A bevel gear 14 as shown in (C) of FIG. 1 is vertically assembled at the driven gear 26 or a driving gear 46*as* will explained thereafter, thereby transmitting the driving force. A plurality of rods 14*a* which are extendedly formed are provided along the circumference at one surface of the bevel gear 14 is provided for easily engaging the bevel gear 14 with the driven gear 26. Also, a square groove 14*b* where accompanying connection elements are assembled is shaped at the center of the other surface of the bevel gear 14, and a cylindrical protrusion 14*c* is formed at the square groove 14*b* with a unitary form. Here, the protrusion 14*c* is protruded at both side ends of the bevel gear 14, so that the wheel 10, the pulley 12, or an axis 22*b* of an accompanying third connection stand can easily assemble everywhere.

(D) of FIG. 1 depicts the wheel cap 16 assembled at the above wheel 10 or the pulley 12, and (E), (F), (G), (H), (I), (J), (K), (L), (M), (N) of FIG. 1 depict the connection elements as a medium for assembling one perfected block.

That is, (E) of FIG. 1 depicts a frist connection stand 18, and the first connection stand 18 is formed with the form of a square post having empty interior. Additionally, an upper surface of the first connection stand 18 is slanted, to a given angle, preferably, to an angle of about 34° (hereinafter, referred to as "slanted surface 18*a*) and fixed ribs 18*b* bent with the form of "(" is shaped at the slanted surface 18*a*, a axis 18*c* is provided with a unitary form between the fixed ribs 18*b*. At this event, each of the accompanying connection elements are assembled at the fixed ribs 18*b*, and the driven gear 16 or the bevel gear 14 is assembled at the axis 18*c*.

(F) of FIG. 1 depicts a second connection stand 20, and the second connection stand 20 has fixing openings 20*a* of the form of square on both sides. Then, the fixing openings 20*a* are connected to each other with a spring 20*b* having the given elasticity and the spring 20*b* is unitarily made of resin. Meantime, the second connection stand 20 is used upon assembling an elephant tractor as shown in 4.

(G) of FIG. 1 depicts a third connection stand 16, in particularly, having the form of the square post and two fixed ribs 22*a* are separatedly shaped at each of surfaces, at any intervals. At this point, two axises 22*b* are shaped at the third connection stand 22 with a unitary form and the axises 22*b* are symmetrical to each other. Herein, connection element are connected at the fixed rib 22*a*, and the driven gear 26 or the bevel gear 14 is assembled at the axises 22*b*.

(H) of FIG. 1 depicts a fourth connection stand 24 having the form of the square post, where the fourth connection stand 24 plays simply the role on connecting the connection elements.

Meanwhile, (I) of FIG. 1 depicts the aforesaid driven gear 26, a square groove 26*a* is formed at one surface of the driven gear 26, and a protrusion 26*b* of the cylindrical form is unitarily made at the center of the square groove 26*a*. Then, all kinds of the connection elements are assembled at the square groove 26*a* and the protrusion 26*b* is provided for easily assembling the wheel 10, the pulley 12, or the axis 22*b* of the third connection stand 22, anywhere.

(I) and (J) of FIG. 1 depict respectively a fifth connection stand 28 of "T" type and a sixth connection stand 30 of "L" type. More particularly, the fifth and sixth connection stands 28 and 30 have the construction where their interior is empty for assembling each of the connection elements into two and three directions.

(L) of FIG. 1 depicts a seventh connection stand 32. The seventh connection stand 32 has an intermediate plate 32*b*, a body 32*a* having the form of the square post is made in a unitary form. In this case, the circumference of the intermediate plate 32*b* is externally protruded in comparison with the circumference of the body 32*a*, thereby generating the interference when the gears 14 and 26 or the connection elements are assembled at the aforementioned body 32*a*.

(M) of FIG. 1 depicts a eighth connection stand 34 having the form of the square post, and a projection 34*b* is provided at the middle of the eighth connection stand 34. At this point, the projection 34*b* is provided for not escaping a connection opening 36 front, in the event that the connection opening 36 is engaged to the eighth connection stand 34.

Herein, the connection opening 36 has a fixed plate 36*b* as shown in (N) of FIG, 1, and an axis 36*a* is unitarily made at the center of the upper end of the fixed plate 36*b*. Here, the immediate portion of the axis 36*a* is cut, preferably the immediate portion thereof is shaped with the type of hook. Therefore, after the axis 36*a* is assembled at the driven gear 26 or the bevel gear 14, the axis 36*a* is not escaped from the driven gear 26 or he bevel gear 14 as well as the axis 36*a* is not destroyed.

(O) of FIG. 1 depicts a shovel connection arm 38 having fixed openings 38*a* and 38*c*, where the fixed openings 38 and 38*c* are connected with a link 38*b*. That is, the fixed opening 38*a* is assembled at an accompanying shovel 40, and the fixed opening 38*c* is assembled at the driven gear 26. Also, the fixed opening 38*a* and 38*c* are moved each other by engagement.

(P) of FIG. 1 depicts the shovel 40 used in the wheel excavator or the bulldozer. Fixed openings 40*a* are respectively made at both sides of the upper end surface of the shovel 40 and the fixed opening 38*a* of the above connection arm 38 is assembled at the fixed opening 40*a*.

(Q) of FIG. 1 depicts a shovel connection stand 42 assembled at the rear surface of the above shovel 40, the shovel connection stand 42 having two fixed openings 42*b*. Namely, the fixed openings 42*b* are connected each other by a hinge 42*a*, wherein one side end is assembled at the shovel 40 and other side end is assembled at the aforesaid connection element, preferably, the eighth connection stand 34.

(R) of FIG. 1 depicts a main frame having the "cross" form and a motor(not shown) is installed in the interior of the main frame 44. In this event, the motor drives the toy that is perfected by assembling with the above gear and the connection elements. Four fixed grooves 44*a* are shaped at the tip of the main frame 44 and the above connection elements is assembled at the fixed grooves 44*a* A driving gear 46 is assemble to receive the driving force of the motor at both side end of the main frame 44. Further, a square groove 46*a* and a projection 46*b* are unitarily formed at one surface of the driving gear 46 and the shovel connection arm 38 as mentioned previously is assembled at the square groove 46*a*. In the meanwhile, a wired remocon(not shown) for operating the motor as not shown is connected at the main frame 44.

Figure 5:
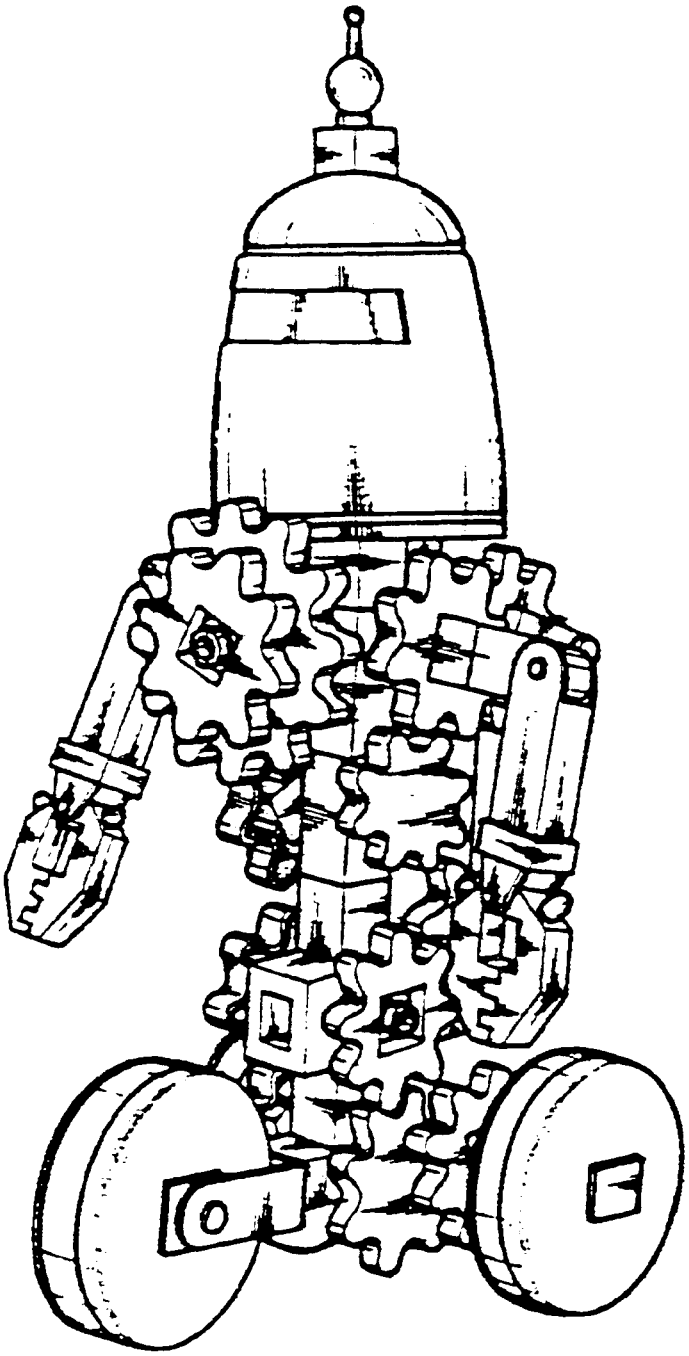

(S) of FIG. 1 depicts a robot arm 48 used upon assembling a robot as shown in FIG. 5, and the robot arm 48 is mainly comprised of three. That is, the robot arm 48 has a long frame 48*c*, a fixed opening 48*a* is assembled by the hinge 48*b* at the upper end of the frame 48*c*, and a tongs 48*f* is assembled by the hinges 48*b* and 48*d* at the lower end of the frame 48*c*. Therein, a knob 48*e* is unitarily shaped at both side of the upper end of the tongs 48*f*, thereby operating the tongs 48*f*. That is, when knobbing and pressing the knob 48*e*, the tongs 48*f* is stretched. To the contrary, when not knobbing and pressing the knob 48*e*, the tongs 48*f* is restored at the original position.

(T) of FIG. 1 depicts a robot wheel 50 used in the event of assembling the robot as shown in FIG. 5. That is, the robot wheel 50 has a bracket 50*b* shaped in the form of "(" and a general wheel 50*d* is assembled at a fixed pin 50*c* in inner surface of the both dies of the bracket 50*b*. Herein, the fixed opening 50 is shaped at the upper end surface of the bracket 50*b* and the aforesaid connection element is assembled at the fixed opening 50.

Figure 6:
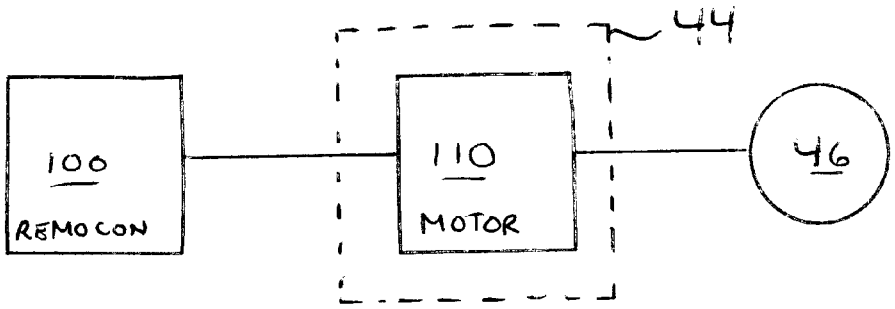
FIG. 6 is a block diagram illustrating the connection of a motor to the driving gear.

FIG. 6 illustrates the connection of a motor 110 to the driving gear 46 for receiving the driving force of the motor 110 as previously described. The motor 110 is housed within main frame 44, as described above. The motor 110 may be operated by wired remocon 100, or remote control.

Meantime, the block elements according to the present invention as constructed above is made of transparent thickness such as ABS resin, for the sake of surely seeing how each of blocks are connected, or how the blocks are operated when children assemble the block as the given form.

Hereinafter, while preferred embodiments of the present invention will be described more concretely, the present invention is not defined by the embodiments as will be provided hereinafter.

Embodiment 1

Figure 2:
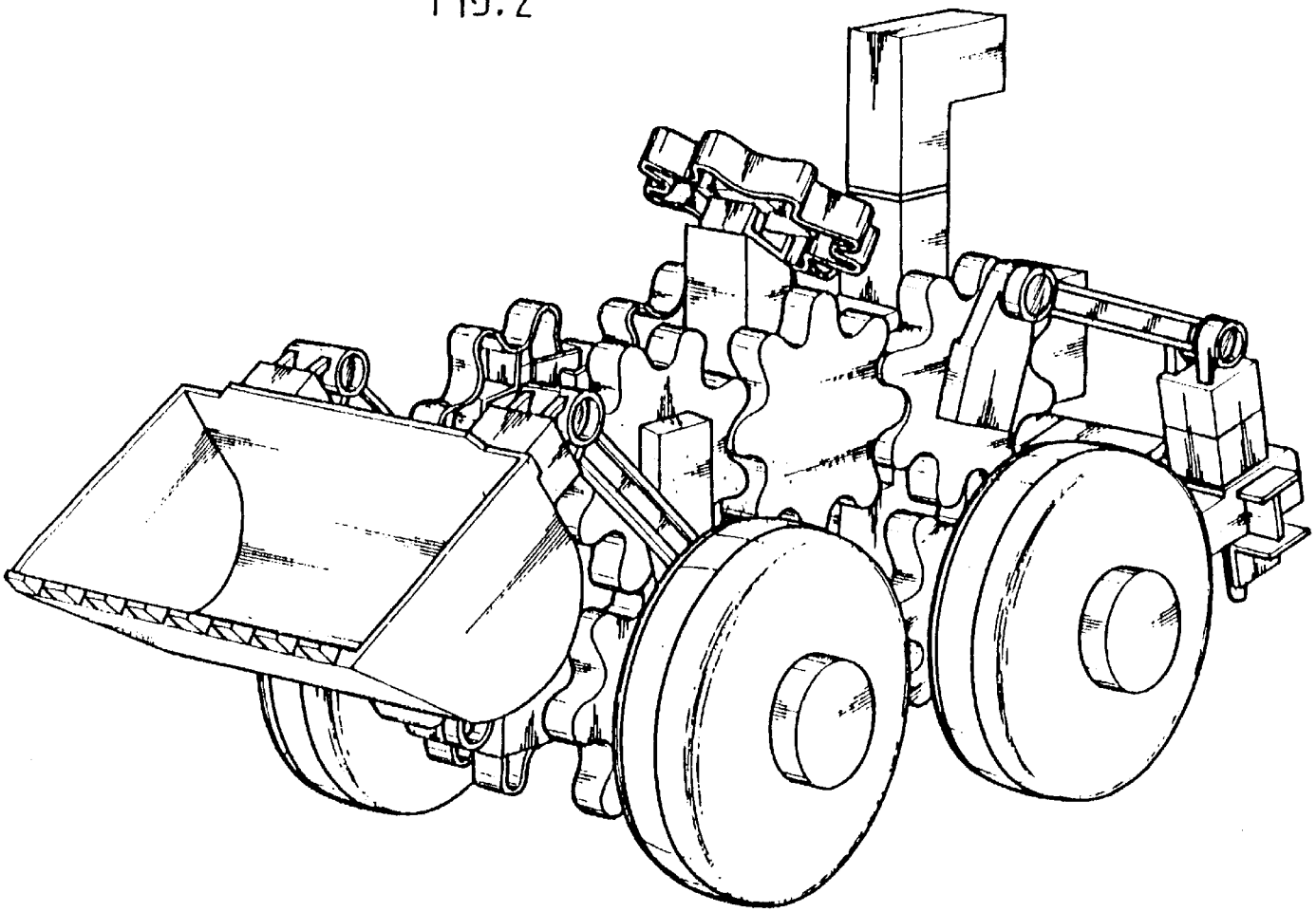
FIG. 2 is a perspective view illustrating the state where a moveable wheel excavator is assembled with using the block elements shown in FIG. 1 according to a first preferred embodiment of the present invention.

When assembling block elements as construction main parts of the present invention as mentioned hereinbefore in accordance with the given order, a wheel excavator as shown in FIG. 2 is made.

In this case, when operating the wired remocon as not shown, the wheel excavator is moved by the operation of the gear, preferably, by the mechanical mechanism.

Embodiment 2

Figure 3:
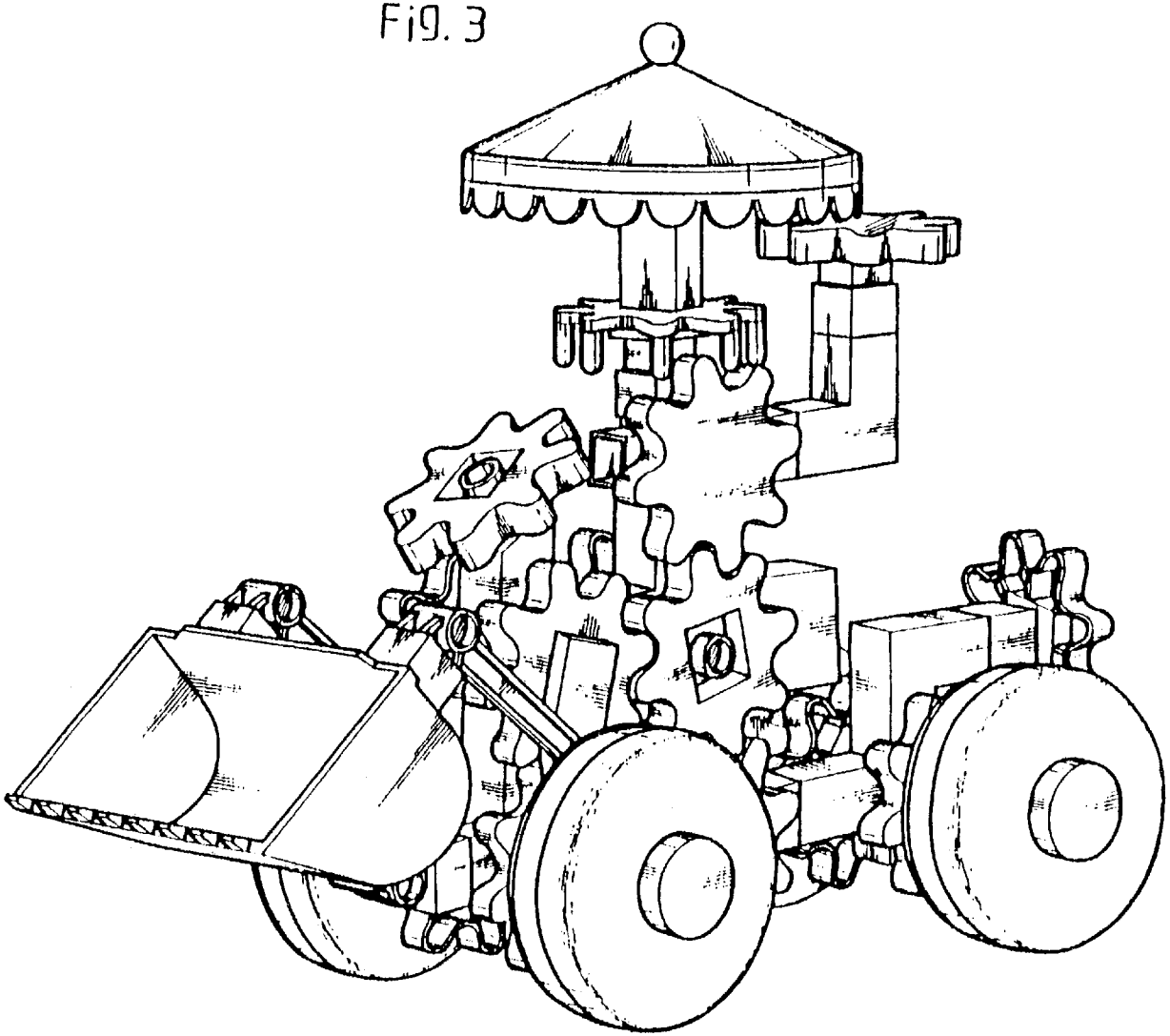
FIG. 3 is a perspective view illustrating the state where a moveable bulldozer is assembled with using the block elements shown in FIG. 1 according to a second preferred embodiment of the present invention.

When assembling block elements as construction main parts of the present invention as mentioned hereinbefore in accordance with the given order, a bulldozer as shown in FIG. 3 is made.

In this case, when operating the wired remocon as not shown, the bulldozer is moved by the operation of the gear Embodiment 3

Figure 4:
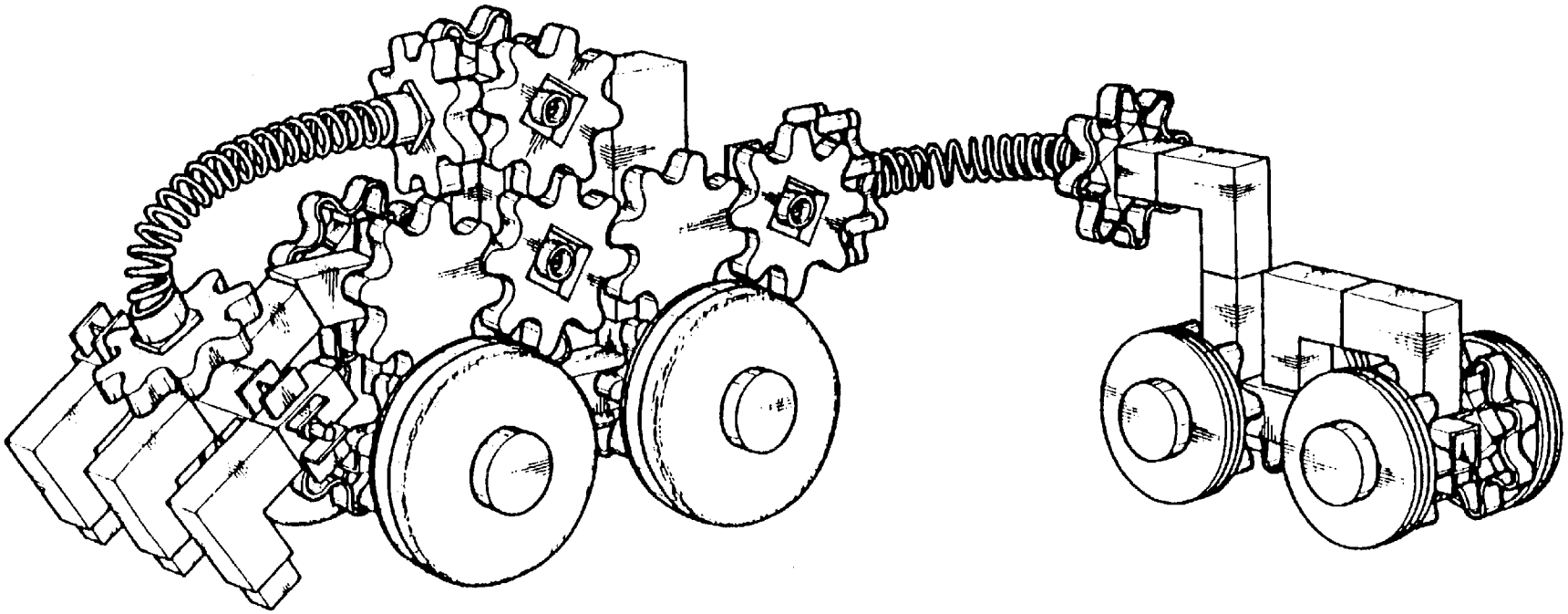
FIG. 4 is a perspective view illustrating the state where a moveable elephant tractor is assembled with using the block elements shown in FIG. 1 according to a third preferred embodiment of the present invention; and, FIG. 5 is a perspective view illustrating the state where a moveable robot is assembled with using the block elements shown in FIG. 1 according to a fourth preferred embodiment of the present invention.

When assembling block elements as construction main parts of the present invention as mentioned hereinbefore in accordance with the given order, an elephant tractor as shown in FIG. 4 is made. Then, two second connection stands 20 are used in the third embodiment.

Meanwhile, upon operating the wired remocon as not shown, the elephant tractor is moved by the operation of the gear.

Embodiment 4

When assembling block elements as construction main parts of the present invention as mentioned hereinbefore in accordance with the given order, a robot as shown in FIG. 5 is made. Meantime, in the case of operating the wired remocon as not shown, the robot is moved by the operation of the gear.

In the meanwhile, when the robot wheel is not used and another robot leg is installed in the fourth embodiment, another robot may be made.

As described above, the concrete description of the present invention is proved about concrete embodiments, however, it will be apparent to one skilled in the art that the present invention may be practiced within the range of the present invention. Namely, it will be apparent thereto that the various forms except for the aforesaid embodiments are assembled with using block elements as shown in FIG. 1.

As may be apparent from the foregoing, the present invention has advantages in that children can naturally know the rotation principle of the gears, promote the thinking faculty in the science, and arouse the interesting therein. Likewise, since the section block toy according to the present invention can move freely, other and separated toy is not necessary. More especially, it has the effect on early realizing the mechanical thinking principle.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A movable, sectional block toy, comprising:

a motor for producing a rotational driving force;

a main frame housing the motor, the main frame being formed in the shape of a cross having two sides and four ends, the ends of the cross having grooves formed therein;

a pair of driving gears connected to the motor for being rotationally driven by said motor, one driving gear being externally located on each side of the cross-shaped main frame;

at least one second gear for rotatably engaging with the driving gear;

a plurality of wheels; and at least one connection stand for connecting the plurality of wheels and at least one second gear and connecting with the grooves in the main frame, the connection stand, second gear, wheels and main frame together forming a unitary body, and the pair of driving gears and at least one second gear being visible for illustrating the mechanical interaction of the gears.

2. The toy according to claim 1, wherein the at least one second gear comprises at least one driven gear engaging one of the driving gears and at least one bevel gear oriented perpendicular to and engaging one of the at least one driven gear or the other of the driving gears.

3. The toy according to claim 2, wherein the bevel gear has vertically depending rods extending from one surface adjacent the circumference for engaging with the driven gear or driving gear.

4. The toy according to claim 1, further comprising a shovel movably connected to the driving gear for moving in response to the driving force of the motor.

5. The toy according to claim 4, further comprising a pair of shovel connection arms and a shovel connection stand, the connection arms and connection stand connected between the shovel and the driving gear to move the shovel upwardly and downwardly in response to the motor driving force.

6. The toy according to claim 5, wherein each shovel connection arms has fixed openings at each end, the fixed openings connecting the connection arm to each of the shovel and one of the driving gears, the fixed openings linked to the connection arm by hinges.

7. The toy according to claim 1, further comprising a robot arm movably connected to the driving gear for moving in response to the driving force of the motor.

8. The toy according to claim 7, wherein the robot arm comprises a fixed opening connected to one second gear, an arm frame rotatably mounted to the fixed opening by a first hinge, and tongs mounted to the arm frame by a second hinge.

9. The toy according to claim 1, wherein the toy is made of a transparent material.

10. The toy according to claim 1, wherein the toy is made from ABS resin.

* * * * *